US005301837A

United States Patent [19]

O'Meara

[11] Patent Number: 5,301,837

[45] Date of Patent: Apr. 12, 1994

[54] CHILD RESISTANT MEDICAMENT DISPENSER

[75] Inventor: John R. O'Meara, Jamesburg, N.J.

[73] Assignee: CP Packaging, Inc., Jamesburg, N.J.

[21] Appl. No.: 830,308

[22] Filed: Jan. 31, 1992

[51] Int. Cl.[5] ..... B67D 5/00

[52] U.S. Cl. ..... 222/83; 222/541

[58] Field of Search ..... 222/81, 83, 153, 519, 222/522, 541; 220/258, 277, 278; 215/206, 226, 250

[56] References Cited

U.S. PATENT DOCUMENTS

| | | | |
|---|---|---|---|
| 1,909,209 | 5/1933 | Miller | 222/81 |
| 2,365,524 | 12/1944 | Court | 222/81 |
| 3,109,562 | 11/1963 | Ferris | 220/278 |
| 4,346,820 | 8/1982 | Cavazza | 222/83 |
| 4,458,820 | 7/1984 | Abrams | 215/250 |
| 4,867,326 | 9/1989 | O'Meara | 215/250 |

FOREIGN PATENT DOCUMENTS

| | | | |
|---|---|---|---|
| 12198 | 8/1991 | World Int. Prop. O. | 222/83 |

*Primary Examiner*—Andres Kashnikow
*Assistant Examiner*—Philippe Derakshani
*Attorney, Agent, or Firm*—Eugene E. Renz, Jr.

[57] ABSTRACT

A child resistant cap and tube assembly, comprising a tube for containing a product and having an end portion with a recessed thin wall section puncturable to provide a discharge opening and a shoulder for limiting axial movement on the end portion. A cap is provided having a central axis for alignment with the tube and sized to slidably engage the end portion. An axially centered puncture is positioned to be aligned with the thin wall section and normally spaced from the thin wall section in a first position and operable to puncture the thin wall upon movement of the cap to a second position for opening the discharge opening. The cap further includes a shoulder for preventing axial movement of the cap from the first position to the second position without intentional manipulation of the shoulder to a shoulder disengaging position. The shoulder comprises a skirt detachably attached to the tube engaging end of the cap, the skirt engaging the shoulder to prevent movement of the cap to the second position until the skirt is removed. The shoulder comprises a boss located on the end portion and the shoulder comprises a socket on the cap. The socket is normally out of alignment with the boss to define the first position and the intentional manipulation includes aligning the boss and the socket to permit movement of the cap to the second position.

14 Claims, 4 Drawing Sheets

FIG. 11
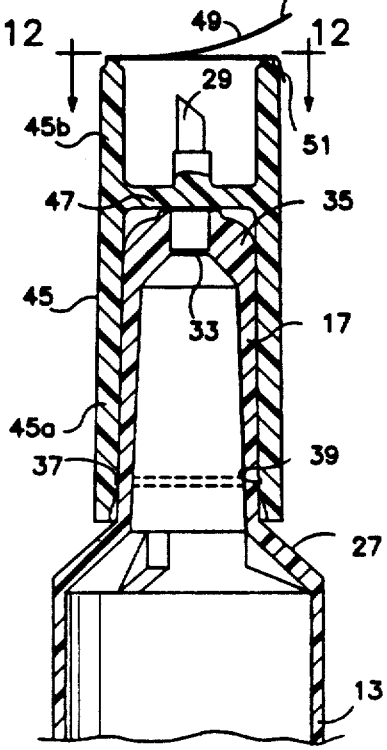
FIG. 12
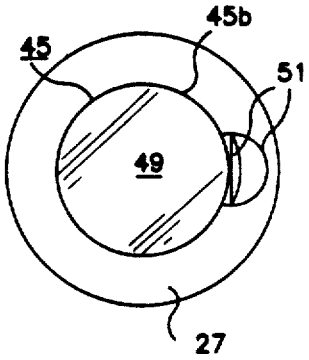
FIG. 13
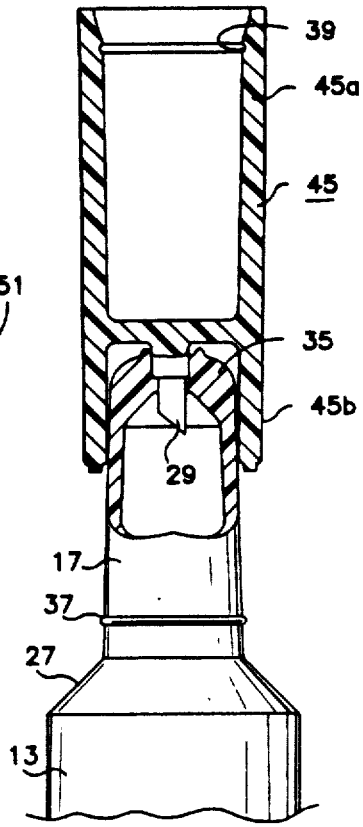
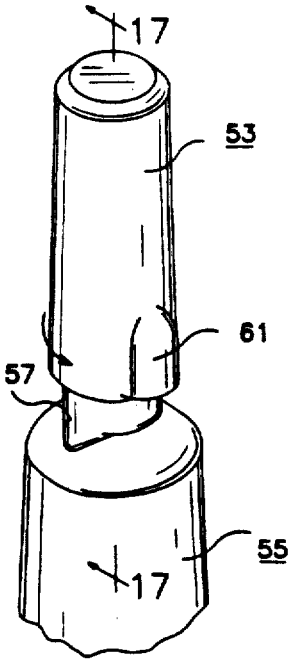
FIG. 14
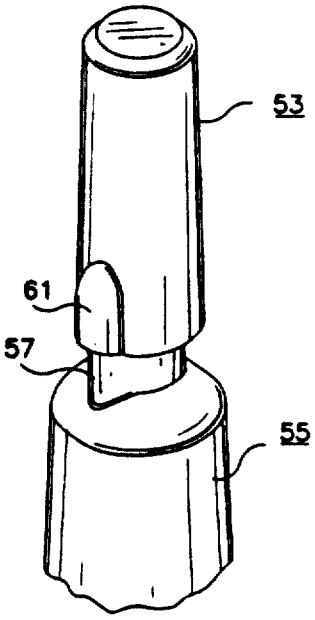
FIG. 15
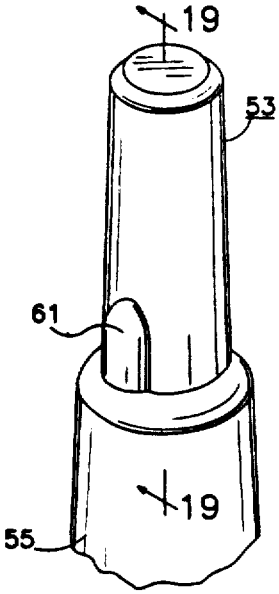
FIG. 16

CHILD RESISTANT MEDICAMENT DISPENSER

FIELD OF THE INVENTION

The present invention relates to a device for containing and dispensing medicaments and other contents, and more particularly to a device in which the requirements for providing access to the contents are such that children and others not skilled in the use of the invention will have difficulty in obtaining access to the contents. In its simplest form, the invention relates to child resistant features which protect the child from unauthorized access to the container contents.

BACKGROUND OF THE INVENTION

The field of child resistant cap and tube assemblies, which carry medicines, vitamins and the like, have become of major importance and interest in the pharmaceutical industry. There is a growing need for container assemblies that are difficult for children to open, particularly accidentally. Also, increased interest is being shown in cap and tube assemblies which cannot be opened by happenstance but which require a specific and positive step to be taken in order to have access to the contents. This is particularly true when medicines, vitamins and topical treatments such as eye drops are contained in such tubes.

In prior art devices, designs have been proposed which include a three piece construction where a tube body contains a plug attached to a portion of the main body of the tube. The wall of the tube has been weakened sufficiently to permit the plug to be torn from the tube. A cap portion is designed so that one end might be fitted over the tube having the plug, thereby protecting the plug and tube. The other end is then designed to interact with the plug in a twisting manner to remove the plug by rupturing the thin wall of the tube to which the plug is attached. This design has not been effective, however, because of the additional concern caused by the existence of the plug and the need for safe and reliable disposal of the plug.

In my prior U.S. Pat. No. 4,867,326, I have developed a child-resistant cap and tube assembly which has a high reliability in pass/fail inspection opportunities. This design permits easy inspection of unit dose sterile medicaments which do not contain preservatives in the product, to avoid use of spoiled or contaminated products.

My prior device has a tube which has one end portion which terminates in an axially centered first opened surface at the outer perimeter of the end portion. Recessed below the surface of the end portion is a thin wall which seals the tube. The tube has a second surface, called a surface of interference, which operates to interfere with axial movement on the end portion. The cap has a resistance surface which interengages the end to locate the cap at a first position where a thin wall portion on the tube is protected. Movement overcoming the restraining efforts of the two surfaces causes a puncture means to move to then puncture the thin wall and provide access to the contents.

One of the difficulties with the prior device in my U.S. Pat. No. 4,867,326 is not that it is not effective. Rather, it has been highly effective in keeping children and others from inadvertently opening the container and causing loss or damage to the contents. It is also suitable for a pass/fail inspection step as the thin wall is clearly visible when the cap is removed. If it appears to have been punctured, the contents or the condition of the thin wall will make that fact easily determined.

One of the features of my prior U.S. Pat. No. 4,867,326 is that the package looks substantially the same before and after activation. This is an appealing appearance but is not suitable in those situations when it is necessary to determine whether or not there has been activation by the mere glance of the eye. In other words, it is not possible to tell at a glance if the child-resistant feature has been overcome in some manner. Accordingly, it is an object of this invention to provide a device which is capable of providing not only child-resistance but also a quick visual warning or sign that the device has in fact been opened.

As is true in any system where axial force is the primary direction in which a system operates, there is another way in which my system described in my U.S. Pat. No. 4,867,326 can be improved. In my prior system, axial activation force was all that was needed to overcome, abeit with substantial force, the interengagement of the resistance surface and the surface of interference. Once this takes place, for whatever reason, the piercer moves to the second position as described in that patent and the thin wall seal which has been protecting the contents is pierced. That is desirable only when the user makes that decision and not merely because the force has been overcome inadvertently. It is therefore another object of this invention to provide a child-resistant tube and cap assembly that requires more than axial force to provide access to the contents. At the same time, it is an object of this invention to provide a device which retains the simple and very effective axial activation system of my U.S. Pat. No. 4,867,326. Thus it is an object of this invention to have the best of my prior design while adding additional features of value.

There is another concern that has become important in the child-resistant container industry, and that is the desire that a conscious mental step be needed in order to move the cap and tube into alignment for activation, and that they are somehow not capable of activation without that conscious step. Stated another way, it is an object of this invention to provide a device which is sufficiently complex to prevent random activity from putting the device in a condition for being activated.

Other objects will appear hereinafter.

SUMMARY OF THE INVENTION

It has now been discovered that the above and other objects of present invention may be accomplished in the following manner. Specifically, a new child resistant cap and tube assembly has been discovered. This assembly includes a tube for containing a product, which tube has an end portion with a recessed thin wall section which is designed to be puncturable to provide a discharge opening for the contents of the tube. There is also provided a shoulder element or portion of the tube which serves to limit axial movement of a cap on the end portion of the tube.

The assembly also includes a cap having a central axis for alignment with the tube. It is sized to slidably engage the end portion of the tube. The cap also has an axially centered puncture means or piercer which is positioned to be aligned with the thin wall section of the tube. The piercer is normally spaced from the thin wall section in a first position which is spaced from the thin wall and where the thin wall is protected from being punctured. The piercer is operable to puncture said thin wall upon movement of the cap to a second position, after which it can be removed so that the contents can be discharged for use.

The cap also has a shoulder engaging part which is used to prevent axial movement of the cap from the first position to said second position without intentional manipulation of this shoulder engaging part to a shoulder disengaging position. There are several embodiments of this portion of the assembly, each of which prevent movement of the cap to the second position and engagement of the piercer and the thin wall is protected and prevented. Once the intentional manipulation is performed, movement to the second position and puncture of the thin wall is easy to accomplish.

In one embodiment, the shoulder is formed by the terminal end of the tube on which the end portion is placed. In this embodiment, the shoulder engaging means comprises a skirt which is detachably attached to the tube engaging end of the cap. The skirt thus engages the shoulder to prevent movement of the cap to the second position until the skirt is removed. One form of this embodiment includes a skirt which is a tear-off skirt that has been frangibly attached to the cap, such as by scoring or the like. The tear-off skirt is adapted to be removed by intentional manipulation, simply by tearing the skirt from the assembly and placing the removed portion in an appropriate disposal container. Alternatively, the skirt may be a split skirt having a frangible seam which is adapted to be split by said intentional manipulation, in this case simply by pushing on the end of the cap.

A preferred embodiment includes the use of a ring and groove, one of each being on the end portion and on the one end of said cap to define the first position upon engagement of the groove and ring. The ring and groove are sized to engage each other with sufficient force to prevent accidental movement of the cap toward the thin wall portion. In this embodiment, the axially centered puncture means is preferably located on the other end of said cap whereby the intentional manipulation includes disengagement of the ring and groove and slideable movement of the other end of the cap to the second position. For sanitary reasons this embodiment includes closure means such as tear-off tape for covering the end of the cap having the axially centered puncture means. Thus, the intentional manipulation also includes removal of the tear-off tape or other closure means prior to movement of the cap to the second position.

In yet another preferred embodiment, the shoulder comprises a boss means located on the end portion of the tube and the shoulder engaging means comprises socket means on the cap. The socket means is normally out of alignment with the boss means and in this manner defines the first position where the piercer is safely spaced from the thin wall of the tube. The intentional manipulation includes aligning the boss means and the socket means to permit movement of the cap to the second position. Once the boss and socket are aligned, there is nothing preventing slideable movement of the piercer through the thin wall of the tube. In this embodiment, the socket should extend radially from the cap at one location on the cap, both to indicate the location and to provide purchase for the twisting movement of the cap on the tube end which will be necessary to align the boss and socket. Also to provide visual location of the boss, the boss extends below the cap when the cap is in the first position.

In this way, the user is able to visually observe the location of both the socket means and the boss means so as to easily make the appropriate alignment and to recognize cap and tube assemblies which have been activated previously. In this manner, this embodiment provides as a tamper evident feature. Similarly, the design which includes a detachable skirt very clearly provides a tamper evident feature. Likewise, the ring and groove embodiment has a tamper evident feature with the removable tear-off tape or other closure, as well with the cap having to be removed and the other end attached to the tube.

BRIEF DESCRIPTION OF THE DRAWINGS

For a more complete understanding of the invention, reference is hereby made to the drawings, in which:

FIG. 11 is an enlarged, fragmentary, sectional elevational view of another embodiment which is different from the embodiment shown in FIG. 1, again illustrating details of construction and assembly.

FIG. 12 is a plan view taken on the line 12,12 of FIG. 11.

FIG. 13 is an enlarged, fragmentary, sectional elevational view of the embodiment shown in FIG. 11, in an activation mode.

FIGS. 14–16 are sequential isometric views illustrating the method of use of another embodiment of the invention shown in FIG. 1, showing the steps needed in order to release the medicament contained within the sealed tube.

DETAILED DESCRIPTION OF THE PREFERRED EMBODIMENT

Figure 4:
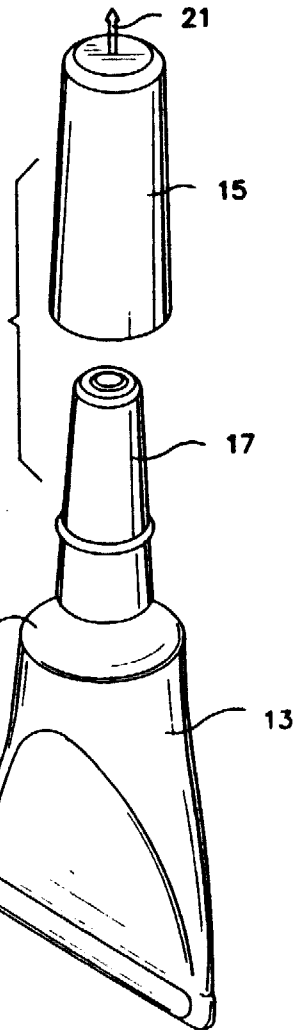
FIGS. 2–4 are sequential isometric views illustrating the method of use of the present invention in order to release the medicament contained within the sealed tube.
Figure 3:
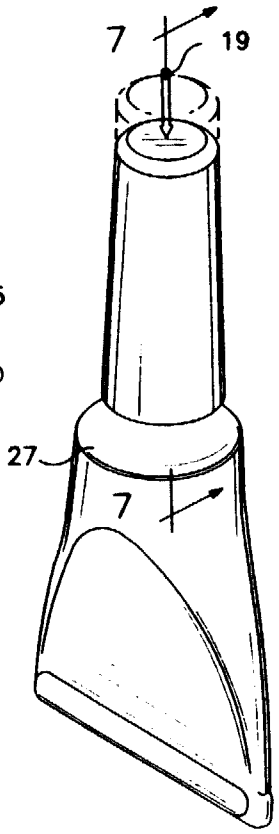

As is noted in the drawings, the assembly of this invention is shown generally by the reference number 10. The assembly includes a tube 13 and cap 15 which is positioned on the discharge or terminal end portion 17 of tube 13. Movement of the cap 15 in the direction of the arrow 19, as shown in FIG. 3, engages a part of the device, described herein below, which provides access to the contents of the tube 13. Movement of cap 15 in the direction of arrow 21 in FIG. 4 removes the cap 15 and allows the contents of the tube to be dispensed. Typically, vitamins, eye drops, and unit dose medicaments are contained in tube and cap assemblies of this type.

Figure 2:
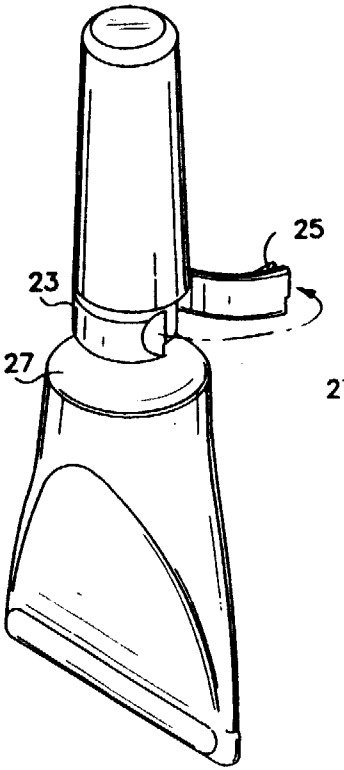
Figure 1:
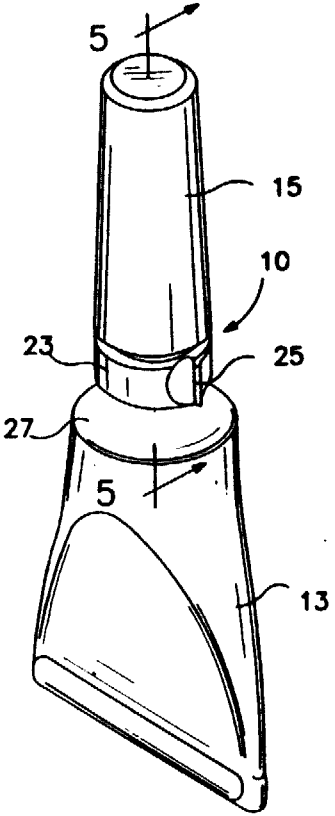
FIG. 1 is an isometric view of a child resistant and tamper evident pierce-pak container, all in accordance with the invention.

Access to the contents in the tube of the present invention is restricted by the assembly of the present invention, requiring an intentional manipulation of a portion of the assembly before access to the contents can be obtained. In FIG. 1, a skirt 23 having a pull tab 25 is located on the tube engaging end of cap 15. This skirt 23 rests on shoulder 27 of tube 13 so that further movement of the cap, such as in the direction of arrow 19 is not possible as long as skirt 23 is still on the cap. Intentional manipulation to remove the skirt 23 by pulling pull tab 25, as illustrated in FIG. 2, places the assembly in a ready to use condition.

Figure 5:
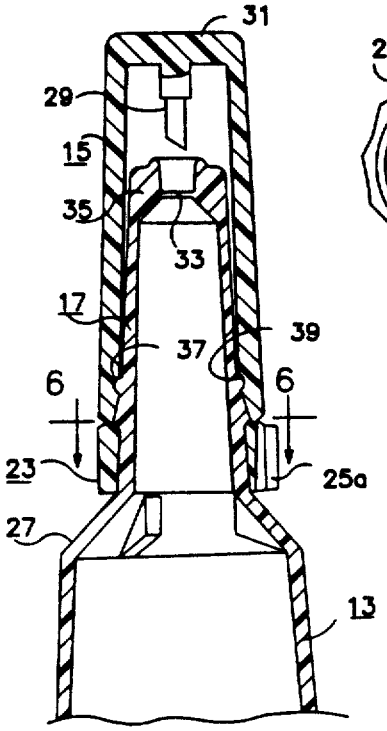
FIG. 5 is an enlarged, fragmentary, sectional elevational view taken along the line 5,5 of FIG. 1, illustrating details of construction and assembly.
Figure 6:
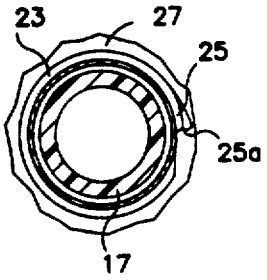
FIG. 6 is a fragmentary, sectional elevational view taken on the line 6,6 of FIG. 5, illustrating additional details of the tear-off skirt.
Figure 7:
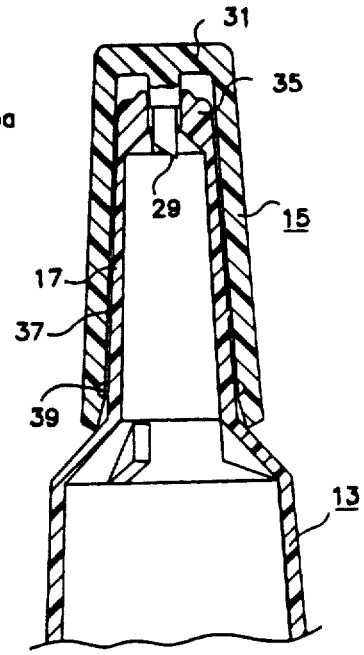
FIG. 7 is an enlarged, fragmentary, sectional elevational view taken along the line 7,7 of FIG. 3.

Turning now to FIGS. 5, 6 and 7, the internal working of the assembly can be seen. In FIG. 5, the device is as shown in FIG. 1 and the skirt 23 abuts shoulder 27 to prevent movement of the cap 15 in the tube engaging direction. The edge 25*a* of pull tab 25 is accessible and the pull tab 25 can be removed easily. This intentional manipulation is necessary for use of the tube. Piercer 29 is mounted on the inside of end wall 31 of cap 15, and is held in a first position as illustrated in FIG. 5. As long as skirt 23 is present, piercer 29 cannot contact thin wall section 33 of tip 35 of tube end portion 17.

Also shown on the assembly illustrated in FIG. 5 is a ring 37 and groove 39 which serves as a secondary restraint to prevent unintentional movement of the cap toward the tube. As shown in FIG. 7, the puncture means or piercer 29 is able to penetrate thin wall section 33, allowing for access to the contents after the cap 15 is removed from the tube end portion 17.

Figure 8:
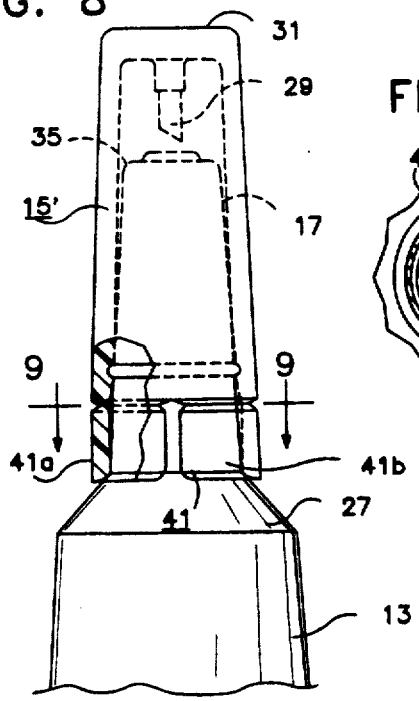
FIG. 8 is an enlarged, fragmentary, elevational view with a portion broken away and in section, showing another embodiment of the invention.
Figure 9:
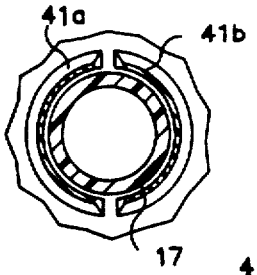
FIG. 9 is a fragmentary, sectional, plan view taken on the line 9,9 of FIG. 8.
Figure 10:
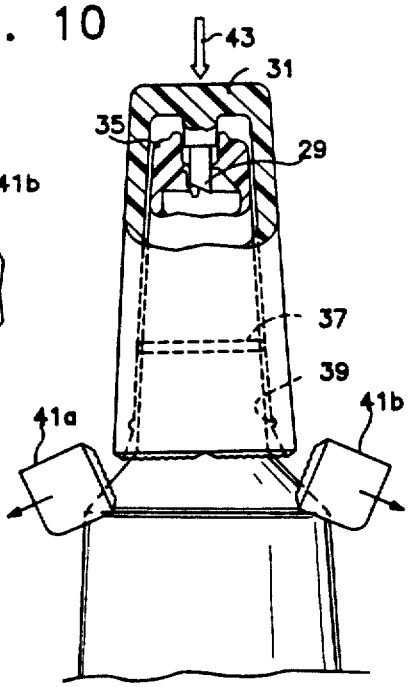
FIG. 10 is a fragmentary, elevational view of the embodiment of FIG. 8, with a portion broken away and in section.

A similar assembly is shown in FIGS. 8, 9 and 10, in which a modification of the skirt previously described is shown. Split skirt 41 restrains movement of cap 15' toward tube 13 because it cannot move past shoulder 27. In this embodiment, intentional manipulation of the assembly to open the tube requires that the cap 15' be pushed axially toward the tube 13 so that split skirt 41 impinges on shoulder 27 in the direction of arrow 43. If sufficient pressure is applied, split skirt 41 splits along a frangible portion, such as produced by score lines, and breaks into two portions 41*a* and 41*b*. Once the skirt 41 has split, cap 15' can be moved to cause piercer 29 to puncture thin wall section 33 as previously described.

Turning now to FIGS. 11, 12 and 13, another assembly according to the present invention is shown. This assembly includes a modified cap 45 which has a first end 45*a* and second end 45*b* separated by dividing wall 47. Piercer 29 is mounted on dividing wall 47 and is facing away from thin wall section 33 of end 35 of tube end portion 17. Piercer 29 is sterilized and kept sanitary by a closure member, shown in FIG. 11 in the form of tear-off tape 49. Tear-off tape 49 seals the end 45*b* of cap 45 and can be removed when needed by pulling tab 51 on tear-off tape 49.

The cap 45, which has been held in place by ring 37 and groove 39, is removed from tube end portion 17, the cap 45 is inverted, the tear-off tape 49 is removed by pulling tab 51, and the end 45*b* of cap 45 is placed in a second position, shown in FIG. 13, where piercer 29 once again punctures thin wall section 33 to provide access to the tube contents.

A preferred embodiment is shown in FIGS. 14–20. In this embodiment, the cap 53 is prevented from moving toward tube 55 by a boss 57 which is part of tube end portion 59. The lower terminal end 53*a* of cap 53 can not move past boss 57, and thus the cap 53 is maintained in its first position, where access to the contents is prevented. Intentional manipulation of cap 53 to bring socket 61 into alignment with boss 57, as illustrated in FIG. 15 allows cap to slide on tube end portion 59 to a second position shown in FIG. 19.

Figure 17:
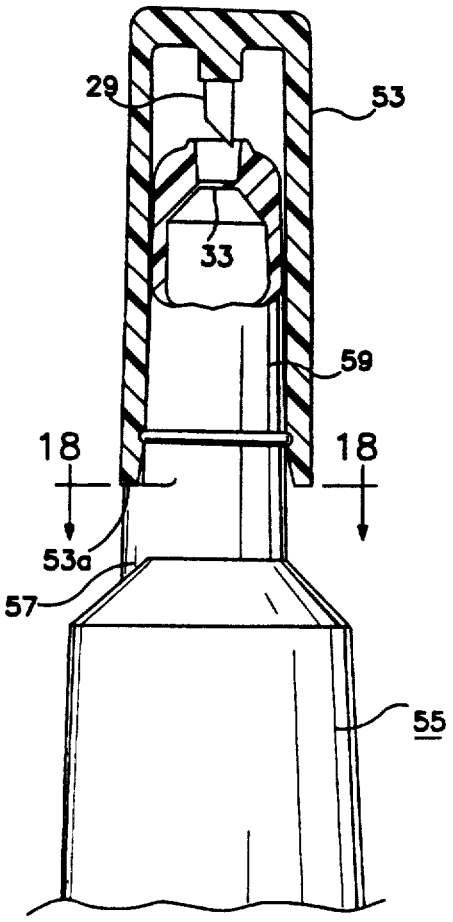
FIG. 17 is an enlarged, fragmentary, sectional elevational view taken along line 17,17 of FIG. 14 illustrating details of construction and assembly.
Figure 19:
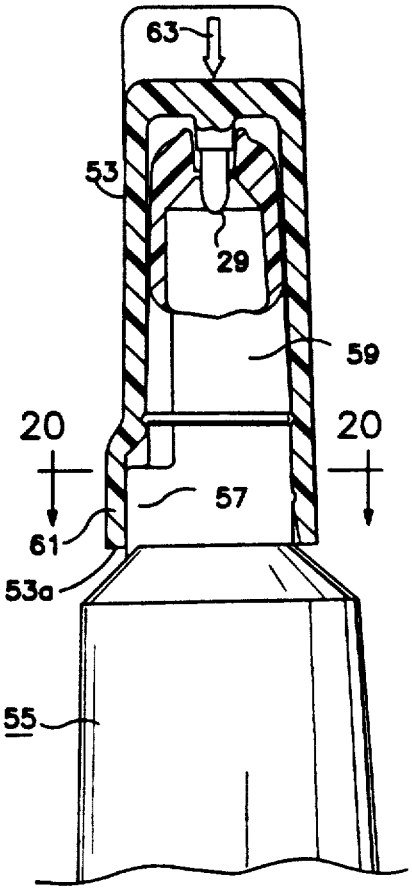
FIG. 19 is an enlarged, fragmentary, sectional elevational view of the embodiment shown in FIG. 17, in an activation mode.
Figure 18:
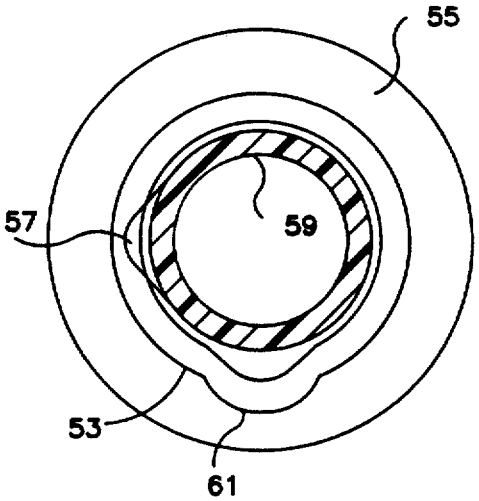
FIG. 18 is an enlarged, sectional, plan view taken on the line 18,18 of FIG. 17.
Figure 20:
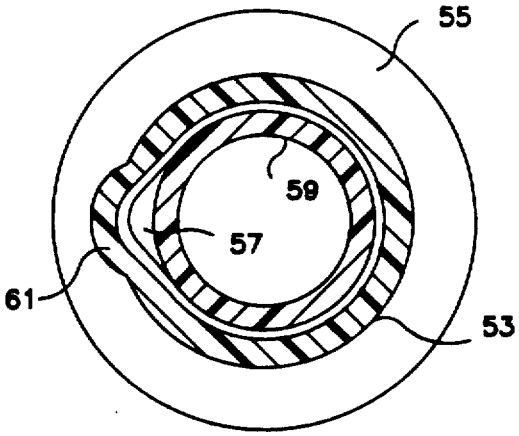
FIG. 20 is a sectional, plan view taken on the line 20,20 of FIG. 19.

When the lower terminal end 53*a* of cap 53 is in contact with boss 57, as shown in FIG. 17, the cap 53 is held in a first position where piercer 29 is spaced from thin wall section 33. Rotation of cap 53 to align boss 57 and socket 61, as shown in FIGS. 19 and 20, allows cap 53 to be pushed in the direction of arrow 63 to provide access to the tube contents. Without the intentional manipulation of the cap 53 from the safe position of FIG. 17 to the ready position of FIG. 19, the assembly is at least child resistant. Casual playing is not likely to cause the needed alignment. When such alignment is desired, pressure on boss 57 and the outside of socket 61 allows the two components to be rotated with respect to each other to achieve a ready to use condition.

In each of the embodiments shown herein, it is necessary to move the cap from a first position with a puncture means spaced from the thin wall section of the end portion of the tube to a second position to permit puncture of the thin wall section. This required or necessary movement of the cap with respect to the tube must be made using intentional manipulation of the assembly. This substantially reduces accidental access to the tube and greatly increases the safety and security of the product being sold.

While particular embodiments of the present invention have been illustrated and described, it is not intended to limit the invention, except as defined by the following claims.

I claim:

1. A child resistant cap and tube assembly, comprising:

a tube for containing a product and having an end portion with a recessed thin wall section puncturable to provide a discharge opening and a shoulder means for limiting axial movement on said end portion:

a cap having a central axis for alignment with said tube and sized to slidably engage said end portion;

an axially centered puncture means positioned to be aligned with said thin wall section and normally spaced from said thin wall section in a first position and operable to puncture said thin wall upon movement of said cap to a second position for opening said discharge opening;

said cap further including shoulder engaging means for preventing axial movement of said cap from said first position to said second position without intentional manipulation of said shoulder engaging means to a shoulder disengaging position;

said shoulder engaging means comprising a skirt detachably attached to the tube engaging end of said cap, said skirt engaging said shoulder to prevent movement of said cap to said second position until said skirt is removed; and said shoulder comprising a boss means located on said end portion and said shoulder engaging means comprising socket means on said cap means, said socket means being normally out of alignment with said boss means to define said first position and said intentional manipulation including aligning said boss means and said socket means to permit movement of said cap to said second position.

2. The assembly of claim 1, wherein said skirt is a tear off skirt frangibly attached to said cap. and adapted to be removed by said intentional manipulation.

3. The assembly of claim 1, wherein said skirt is a split skirt having a frangible seam adapted to be split by said intentional manipulation.

4. The assembly of claim 1, wherein said shoulder and said shoulder engaging means comprises a ring and groove, one of each being on said end portion and on said one end of said cap to define said first position upon engagement of said groove and ring, said axially centered puncture means being located on the other end of said cap whereby said intentional manipulation includes disengagement of said ring and groove and slideable movement of said other end of said cap to said second position.

5. The apparatus of claim 1, which further includes closure means covering the end of said cap having said axially centered puncture means, whereby said intentional manipulation also includes removal of said closure means prior to movement of said cap to said second position.

6. A child resistant cap and tube assembly, comprising:

a tube for containing a product and having an end portion with a recessed thin wall section puncturable to provide a discharge opening and a shoulder means for limiting axial movement on said end portion;

a cap having a control axis for alignment with said tube and sized to slidably engage said end portion;

an axially centered puncture means positioned to be aligned with said thin wall section and normally spaced from said thin wall section in a first position and operable to puncture said thin wall upon movement of said cap to a second position for opening said discharge opening;

said cap further including shoulder engaging means for preventing axial movement of said cap from said first position to said second position without intentional manipulation of said shoulder engaging means to a shoulder disengaging position; and said shoulder comprising a boss means located on said end portion and said shoulder engaging means comprising socket means on said cap means, said socket means being normally out of alignment with said boss means to define said first position and said intentional manipulation includes aligning said boss means and said socket means to permit movement of said cap to said second position;

said socket means extending radially from said cap at one location on said cap and said boss means extending below said cap when said cap is in said first position to permit visual observation of both said socket means and said boss means in said first position.

7. The apparatus of claim 6, wherein said skirt is a tear off skirt frangibly attached to said cap. and adapted to be removed by said intentional manipulation.

8. The apparatus of claim 6, wherein said skirt is a split skirt having a frangible seam adapted to be split by said intentional manipulation.

9. The apparatus of claim 6, which further includes closure means covering the end of said cap having said axially centered puncture means, whereby said intentional manipulation also includes removal of said closure means prior to movement of said cap to said second position.

10. A child resistant cap and tube assembly, comprising:

a tube for containing a product and having an end portion with a recessed thin wall section puncturable to provide a discharge opening and a shoulder means for limiting axial movement on said end portion;

a cap having a central axis for alignment with said tube and sized to slidably engage said end portion;

an axially centered puncture means positioned to be aligned with said thin wall section and normally spaced from said thin wall section in a first position and operable to puncture said thin wall upon movement of said cap to a second position for opening said discharge opening;

said cap further including shoulder engaging means for preventing axial movement of said cap from said first position to said second position without intentional manipulation of said shoulder engaging means to a shoulder disengaging position;

said shoulder comprising a boss means located on said end portion and said shoulder engaging means comprising socket means on said cap means, said socket means being normally out of alignment with said boss means to define said first position and said intentional manipulation includes aligning said boss means and said socket means to permit movement of said cap to said second position.

11. A child resistant cap and tube assembly, comprising:

a tube for containing a product and having an end portion with a recessed thin wall diaphragm puncturable to provide a discharge opening and a shoulder means for limiting axial movement on said end portion;

a cap having a central axis for alignment with said tube and sized to slidably engage said end portion:

an axially centered puncture means positioned to be aligned with said thin wall diaphragm and normally spaced from said thin wall diaphragm in a first position and operable to puncture said thin wall diaphragm upon movement of said cap to a second position for opening said discharge opening;

interengaging complementary means on said cap and tube permitting independent axial and rotary movements of the cap with respect to the tube whereby the said tube and cap may be selectively positioned in said first or second position.

12. A child resistant cap and tube assembly as claimed in claim 11, wherein said interengaging complementary means comprises a radial outward projection on the tube and an enlarged pocket on the lower portion of the cap, the lower edge of said tube engaging on said projection in said first position and the pocket engaging over the projection in said second position.

13. A child resistant cap and tube assembly as claimed in claim 11, wherein the lower edge of said cap is outwardly beveled.

14. A child resistant cap and tube assembly as claimed in claim 11, wherein said tube includes a circumferentially extending radially outwardly directed rib spaced upwardly from said interengaging complementary engaging means on said cap and wherein said cap has a complementary groove on the interior which interengages the rib in said first position.

* * * * *